US005275122A

United States Patent [19]

Stolz et al.

[11] Patent Number: 5,275,122

[45] Date of Patent: Jan. 4, 1994

[54] THEFT-DETERRENT DEVICE

[75] Inventors: Kjell Stolz, Stockholm; Klas Stoltz; Bo Gustavsson, both of Huddinge, all of Sweden

[73] Assignee: Fargklamman Svensda AB, Huddinge, Sweden

[21] Appl. No.: 946,211

[22] PCT Filed: Sep. 3, 1991

[86] PCT No.: PCT/SE91/00576

§ 371 Date: Sep. 17, 1992

§ 102(e) Date: Sep. 17, 1992

[87] PCT Pub. No.: WO92/04705

PCT Pub. Date: Mar. 19, 1992

[30] Foreign Application Priority Data

Sep. 3, 1990 [SE] Sweden ..... 9002800

[51] Int. Cl.[5] ..... E05B 65/00; A44B 9/00

[52] U.S. Cl. ..... 116/200; 70/57.1; 116/212

[58] Field of Search ..... 24/704.1, 706.8, 707.1, 24/711.4, 711.5; 70/57.1; 109/29, 34; 116/75, 200, 211, 212, 214

[56] References Cited

U.S. PATENT DOCUMENTS 4,483,049 11/1984 Gustavsson et al. ..... 24/707.1 X 5,031,287 7/1991 Charlot, Jr. et al. ..... 24/704.1

5,054,172 10/1991 Hogan et al. ..... 24/704.1

FOREIGN PATENT DOCUMENTS 423938 6/1982 Sweden .

443886 3/1986 Sweden .

1446711 8/1976 United Kingdom .

1450397 9/1976 United Kingdom .

*Primary Examiner*—William A. Cuchlinski, Jr.

*Assistant Examiner*—W. Morris Worth

*Attorney, Agent, or Firm*—Sheridan Neimark

[57] ABSTRACT

A theft deterrent device, intended to be attached to a theft-attractive article so that it can be removed from the article with the aid of a deterrent release device in the possession of an authorized person, and such that any other form of removal will result in damage to the article concerned, includes a first element (10) having a connecting pin (12) which is intended to be inserted through the article to be protected, and a second element (13) which is intended for attachment to the connecting pin. The first element 10 includes a fragile ampule (17) which contains a staining liquid and which becomes fractured upon manipulation of the connecting pin 12. The ampule is positioned in such a way so that by applying a pulling force on the connecting pin in a direction away from the first element (10), the ampule will flex and break.

19 Claims, 2 Drawing Sheets

THEFT-DETERRENT DEVICE

FIELD OF INVENTION

The invention relates to a theft deterrent of the kind intended to be attached to a theft-attractive article in a manner such that the deterrent can only be removed from the article with the aid of a deterrent release device held in the possession of an authorized person, and such that any other form of removal will result in damage to the theft-attractive article;

BACKGROUND OF THE INVENTION

Theft deterrents of this kind are used to prevent the theft of attractive and easily carried goods from retail shops, particularly from departmental stores, for instance such goods as clothes, bags, handbags and the like, or to cause people to refrain from stealing such goods. One such known theft deterrent is intended to be attached to respective article in a manner such that the deterrent can only be removed from the article concerned with the aid of a special deterrent release device. It is assumed that a potential thief will not have access to this special release device, at least not in the place where the article is on sale. The purpose of such theft deterrents is to render the article unusable to all practical purposes should an attempt is made to remove or to force the deterrent without the aid of the special release device, either by tearing the article or by staining the article with a dye or some other appropriate staining substance contained in a fragile ampule which is broken as a result of attempting to remove the deterrent without the aid of said device.

The theft deterrent may also be augmented with an alarm system, which is triggered by a sensor arrangement located at the exits from the store in which the theft-protected article is on sale.

SUMMARY OF THE INVENTION

One object of the present invention is to provide a theft deterrent of the aforesaid kind which although being of simple construction will nevertheless function reliably and can be manufactured at low cost. This object is realized by means of an inventive theft deterrent including a frangible ampule containing a staining substance supported in a base from which projects an elongated connecting element including an abutment part located on the side of the ampule opposite to the direction of projection of the elongated connecting element, whereby upon an unauthorized attempt to remove a second element attached to the elongated connecting element, the abutment part comes into engagement with the ampule and causes it to break so as to release the staining substance.

BRIEF DESCRIPTION OF DRAWING

The invention will now be described in more detail with reference to the accompanying drawing, which illustrates an exemplifying embodiment of the invention in a much enlarged scale.

DETAILED DESCRIPTION OF A PREFERRED EMBODIMENT

Figure 1:
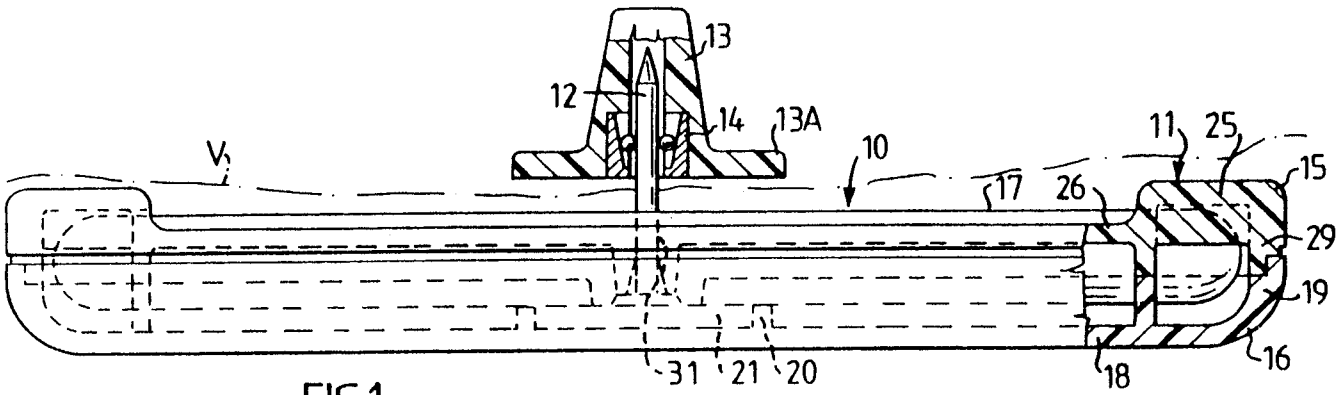
FIG. 1 is a side view of an inventive theft deterrent, wherein the article to which the deterrent is attached is indicated purely schematically.

The theft deterrent illustrated in FIG. 1 has two main parts, namely a base element 10 which is comprised of a plate-like part 11 and a connecting pin 12 which projects out from said plate-like part, and a locking element or head 13 which is mounted on the pin 12 and which has a flange 13A. FIG. 1 shows the theft deterrent secured to an article V which is shown schematically by a chain line, and which may be made of cloth, leather or some other fabric material, at least at the location where the theft deterrent is secured to the article.

The theft deterrent is secured to the article by inserting the pin 12 on the base element 10 through said article V at some appropriate position thereon, or by inserting said pin through a small hole pre-formed in the article, for instance through a buttonhole or a lace hole, and then attaching the head 13 to the free end of the pin 12 now projecting from the article.

Provided internally of the head 13 is a locking device, generally referenced 14 in FIG. 1, which is constructed so that the head 13 can be easily moved axially on the pin 12 in one direction, namely in a direction towards the plate-like part 11, whereas any attempt to move the head in the opposite direction, away from the plate-like part 11, will cause the head to be immediately locked to the pin.

The embodiment of the locking arrangement 14 illustrated schematically in FIG. 1, the structural design of which arrangement 14 forms no part of the present invention, the locking arrangement includes a number of small metal balls which are disposed in internal grooves in the head 13 in a manner to cause the balls to be clamped firmly against the pin 12 and the bottom of the grooves when the head 13 is drawn outwards, and such as to allow the head to be moved inwardly along the pin. The locking arrangement may, of course, comprise other types of one-way couplings.

The locking arrangement 14 may be rendered inoperative with the aid of an appropriate release device (not shown), so that the head 13, and therewith the entire theft deterrent, can be removed readily from the article concerned, for example subsequent to having paid for the article or subsequent to having received a receipt. The intention, of course, is that only authorized persons, for instance cash register personnel, shall have access to the deterrent release device.

Figure 2:
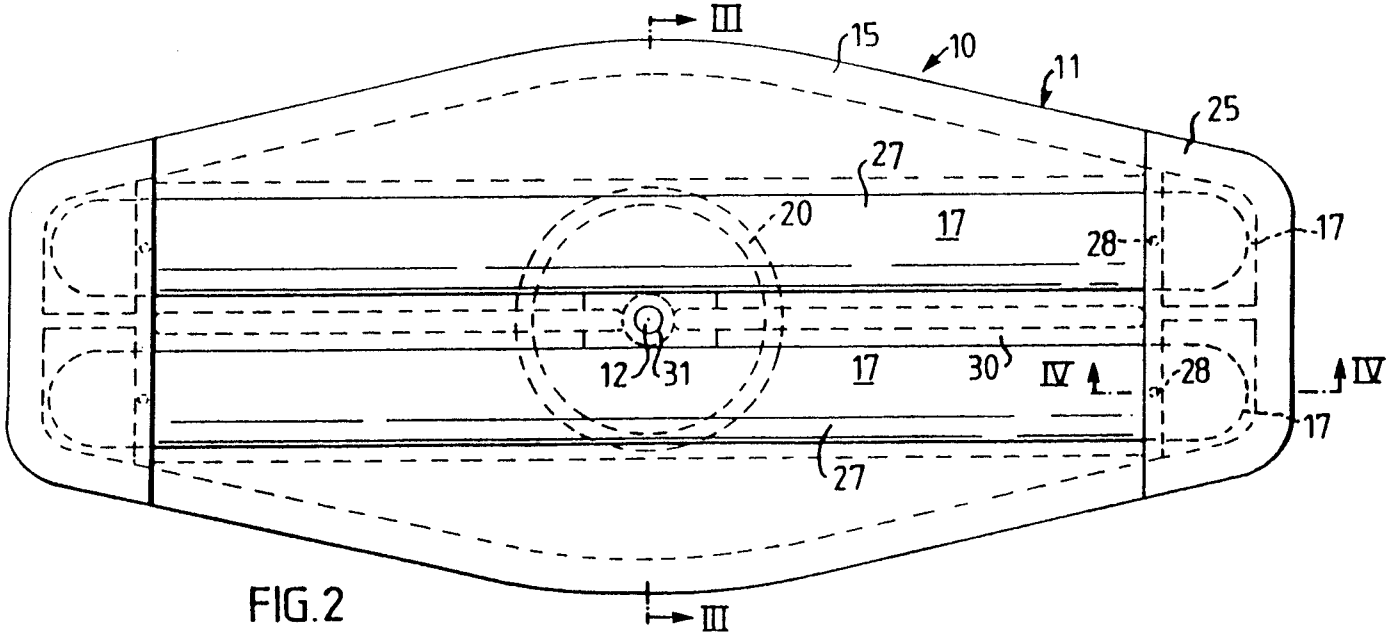
FIG. 2 illustrates the base element of the deterrent from above.

The plate-like part 11 of the base element 10 has the form of a plastic casing or housing which, when seen from above, has the shape of an elongated, six-sided figure with rounded corners, as shown in FIG. 2. The casing is comprised of an upper part 15 and a bottom part 16 which is welded to said upper part or is fixed permanently thereto in some other way. The two casing parts 15, 16 enclose therebetween two tubular, circular-cylindrical ampules 17 made of glass or some other fragile material, these ampules being arranged in a manner described in more detail hereinafter. The ampules 17 are under a given internal overpressure and include a liquid marking substance, in the form of a dye optionally in combination with an ill-smelling substance.

The bottom part 16 comprises a generally flat, continuous bottom wall 18 and an upstanding edge flange 19 which extends circumferentially around the bottom wall 18. Located centrally on the upper side of the bottom wall 18 is an upstanding, annular flange 20 which functions to position a circular, disc-like abutment part (head) 21 on the pin 12. Provided slightly inwardly of each short side of the bottom part 16 on the upper side of the bottom wall is a pair of seats 22 (FIG. 4) which accommodate respective ends of the ampules 17. When seen in the longitudinal direction of the base element 10, these seats have a V-shape, so as to fixate the ampules downwardly and horizontally in their transverse direction.

The upper casing part 15 has an upstanding shoulder 25 on each short side thereof and a substantially flat upper wall 26 which extends between said shoulders and which is provided with a pair of longitudinally extending, mutually parallel slots 27 whose widths correspond to the diameters of the ampules 17. As will be seen from FIGS. 2 and 3, the major part of the ampules 17 lies in these slots; solely the end parts of the ampules extend beyond the extremities of the slots and into the shoulders 25. The ampules are fixated vertically within the shoulders by a pair of low, downwardly directed beads 28.

The ampules 17 are thus fixated in their transverse directions within the casing, by supporting each end of the ampules at three points which are spaced generally uniformly around the circumference of the ampule and of which one support is provided by one of the aforesaid beads and the other two supports are formed by the sloping side walls of a respective seat 22. The ampules are fixated in their longitudinal directions, with a given degree of play, by a downwardly directed edge flange 29 on the upper casing part 15.

Figure 4:
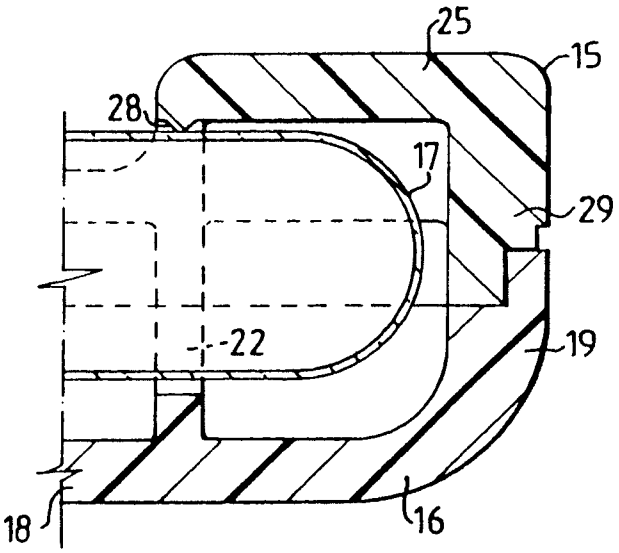
FIG. 4 is a longitudinal section view in larger scale of the end part of the base element, taken on the line IV—IV in FIG. 2.
Figure 3:
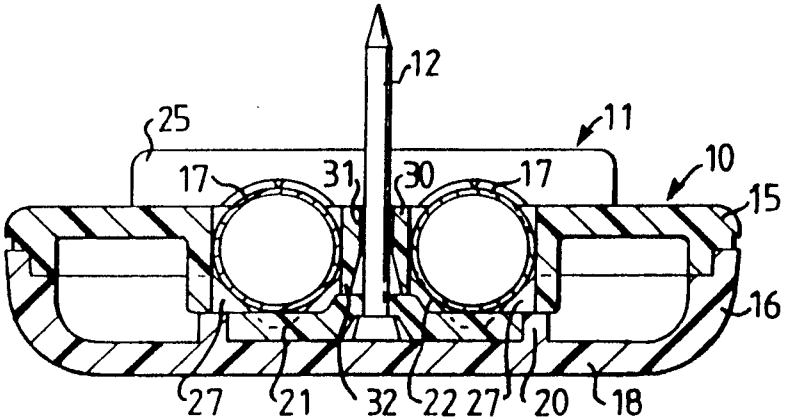
FIG. 3 is a cross-sectional view of the base element taken on the line III—III in FIG. 2.

It will also be seen from FIGS. 2-4 that the part of the ampules 17 extending between their fixated ends is able to move freely in a vertical direction relative to the upper casing part and the lower casing part. This freedom of movement is significant to the function of the theft deterrent, as will be evident from the following description.

Between the two slots 27, the upper casing part 15 has a narrow bridge or bar 30 whose ends are joined materially with the shoulders 25. Provided centrally of the bridge is a hole 31 through which the pin 12 extends with a loose fit. The underside of the bar 30 has a downwardly directed collar 32 which surrounds the hole 31, see in particular FIGS. 1 and 3.

As will best be seen from FIG. 3, the abutment part 21 on the pin 12 is enclosed between the bottom edge surface of the collar 32 and the bottom wall 19 on the bottom casing part 16 in the absence of vertical play or with only slight vertical play, wherein the abutment part 21 projects laterally slightly beyond the lowest part of the ampule 17, i.e. slightly beyond the vertical plane through the geometric axes of the ampules, although not completely up to those parts of the upper casing part 15 which form the outer walls of the slots 27.

When the head 13, and thus the pin 12, is subjected to an upward pulling force, the abutment part 21 will therefore tend to lift both the centre part of the bar 30 and the centre part of the ampules 17. Since the ends of the bar 30 are firmly joined to the shoulders 25 of the upper casing part 15 and the ends of the ampules 17 are held immoveable against upward movement, this lifting force is counteracted partly by the bending resistance presented by the bar and partly by the bending resistance presented by the ampules; both the bar and the ampules can be said to constitute two-sided clamped or supported beams which are subjected to an upwardly acting punctiform load in the centre thereof when an upward pulling force is exerted on the pin 12.

The bridge 30 is relatively slim and because of the elasticity of the plastic material and its low elasticity modulus, the bridge is able to bend upwards relatively easily under the action of this punctiform load without being damaged. The ampules 17, on the other hand, are rigid and also fragile and consequently they cannot withstand any large load without fracturing; they can fracture as a result of being crushed by the pressure force at the point at which the load is applied and/or as a result of an excessively large bending force created by the load applied thereto.

Consequently, any attempt to pull the head 13 free from the pin 12 will result in crushing or fracturing of the ampules 17, so as to release the dye substance immediately the upwardly acting pulling force and/or the lateral forces acting on the head, and therewith also on the pin, exceed a given limit value, therewith rendering the article unusable to all practical intents and purposes. Naturally, the aforesaid limit value is sufficiently high to enable the article or the theft deterrent to be handled normally without danger of exceeding said limit value. The provision of two ampules positioned side-by-side provides the added security that at least one ampule will fracture even though the pin is only subjected to essentially lateral load.

As will best be seen from FIGS. 1 and 3, the ampules 17 protrude slightly (e.g. 0.5-1 mm) above the upper side of the wall 26 of the upper casing part 15. This effectively protects the ampules from being crushed or broken during normal handling of the theft deterrent and the article to which it is attached, although if an unlawful attempt is made to remove the head 13 or to cut the pin 12 with the aid of a tool inserted between the base part 11 and the head flange 13A, it is highly probable that at least one of the ampules will be crushed or broken in the process.

We claim:

1. In an article-protecting theft deterrent including a first element which comprises a base element (10), an elongated, generally needle-shaped connecting element (12) which projects from said base element (10) and which is intended for insertion through said article, and a second element comprising a head (13) which is intended for attachment to the connecting element (12) and which is locked on said element against movement away from the base element (10) so as to hold the theft deterrent on said article, wherein the base element (10) is provided with a rigid and fragile, tubular ampule (17) which contains a staining substance and which is intended to fracture when the connecting element is manipulated, such as to release the staining substance from said ampule (17), said tubular ampule having a central portion and two ends, the improvement comprising supporting means for supporting the ampule (17) at least adjacent both ends thereof against movement in a direction away from the base element (10) in a manner such that said central portion can be moved in said direction to cause fracture and breaking of said ampule; and the connecting element (12) includes an abutment part (21) which is located on a side of the central portion of the ampule (17) which is opposite to said direction and which is intended to come into engagement with the ampule (17) when an attempt is made to manipulate the connecting element (12).

2. A theft deterrent according to claim 1, wherein the ampule (17) is disposed along a bar like bridging element (30); the connecting element (12) is located adjacent said bridging element (30); and in that said bridging element can be moved by exerting a pulling force on the connecting element (12) in a direction away from the base element (10).

3. A theft deterrent according to claim 2, wherein the bridging element (30) can be bent by exerting a pulling force on the connecting element (12) in a direction away from the base element (10) and is secured at its mutually opposite ends; and the ends of the ampule (17) are located adjacent the ends of the bridging element (30).

4. A theft deterrent according to claim 2, wherein the major part of the length of said ampule (17) is fitted slidingly in a slot (27) having one side formed by a side surface of the bridging element (30).

5. A theft deterrent according to claim 2, wherein the base element (10) has fitted therein a further marking-substance ampule (17) which contains a staining substance and two ends of which are supported by said base element against movement in said direction; and the ampules (17) are arranged side-by-side, parallel with the bridging element (30).

6. A theft deterrent according to claim 2, wherein the connecting element (12) extends slidingly through the bridging element (30) and has a disc-shaped head on the end thereof located within the base element (10), said disc-shaped head forming said abutment part (21).

7. A theft deterrent according to claim 2 wherein a major part of the length of the ampule extends up over an outwardly turned wall surface (26) on the base element (10) on a side thereof from which the connecting element (12) projects.

8. A theft deterrent according to claim 7, wherein the ends of the ampule are enclosed in the base element (10).

9. A theft deterrent according to claim 3, wherein the major part of the length of said ampule (17) is fitted slidingly in a slot (27) having one side formed by a side surface of the bridging element (30).

10. A theft deterrent according to claim 3, wherein the base element (10) has fitted therein a further marking-substance ampule (17) which contains a staining substance and two ends of which are supported against movement in said direction; and the ampules (17) are arranged side-by-side, parallel with the bar (30).

11. A theft deterrent according to claim 3, wherein the connecting element (12) extends slidingly through the bridging element (30) and has a disc-shaped head on the end thereof located within the base element (10), said disc-shaped head forming said abutment part (21).

12. A theft deterrent according to claim 3, wherein a major part of the length of the ampule extends up over an outwardly turned wall surface (26) on the base element (10) on a side thereof from which the connecting element (12) projects.

13. A theft deterrent according to claim 12, wherein the ends of the ampule are enclosed in the base element (10).

14. In an article-protecting theft deterrent including a first element which comprises a base element, an elongated, generally needle-shaped connecting element which projects from said base element and which is intended for insertion through said article, and a second element comprising a head which is intended for attachment to the connecting element and which is locked on said element against movement away from the base element so as to hold the theft deterrent on said article, wherein the base element is provided with a rigid and fragile tubular ampule which contains a staining substance and which is intended to fracture when the connecting element is manipulated, such as to release the staining substance from said ampule, said tubular ampule having a central portion and two ends, the improvement comprising supporting means for supporting the ampule at least adjacent both ends thereof against movement in a direction away from the base element in a manner such that said central portion can be moved in said direction to cause fracture and breaking of said ampule; and the connecting element includes an abutment part extending only a part of the length of said ampule and located directly against a side of the central portion of the ampule which is opposite to said direction and which is intended to come into engagement with the ampule when an attempt is made to manipulate the connecting element.

15. A theft deterrent according to claim 14, wherein the base element (10) has fitted therein a second rigid and fragile tubular ampule containing a staining substance, said second ampule having a central portion and two ends and being arranged side-by-side and parallel with the first mentioned tubular ampule, said second ampule being supported adjacent both ends thereof against movement in a direction away from the base element by said supporting means in a manner such that its central portion can move in said direction more easily than its ends to cause fracture and breaking of said second ampule, said connecting element extending between the central portions of said ampules, and said abutment part of said connecting element also being located directly against a side of the central portion of the second ampule which is opposite to said direction and which is intended to come into engagement with the second ampule when an attempt is made to manipulate the connecting element.

16. A theft deterrent according to claim 15, wherein said abutment part is disk-shaped.

17. A theft deterrent according to claim 16, wherein said ampules are at least partially covered by a top wall (25).

18. A theft deterrent according to claim 15, wherein said ampules are at least partially covered by a top wall (25).

19. A theft-deterrent device according to claim 14, wherein said supporting means comprises an upper shoulder portion of said base element overlying said ampule adjacent each end thereof.

* * * * *